United States Patent [19]

Magera

[11] Patent Number: 4,591,340

[45] Date of Patent: May 27, 1986

[54] REFRACTORY INSULATING SHIELDS FOR WATER-COOLED PIPES

[76] Inventor: Matthias R. Magera, R.D. #4, Box 13, McDonald, Pa. 15057

[21] Appl. No.: 613,442

[22] Filed: May 24, 1984

[51] Int. Cl.[4] ..... F27D 3/02

[52] U.S. Cl. ..... 432/234; 285/47; 138/147; 138/149

[58] Field of Search ..... 285/47, 422, 41; 138/147, 149, DIG. 11; 432/233, 234

[56] References Cited

U.S. PATENT DOCUMENTS

| | | | |
|---|---|---|---|
| 4,225,307 | 9/1980 | Magera | 138/147 X |
| 4,290,457 | 9/1981 | Campbell | 138/147 X |
| 4,312,385 | 1/1982 | Magera | 138/147 X |
| 4,362,506 | 12/1982 | Campbell | 432/234 |

*Primary Examiner*—Richard J. Scanlan, Jr.
*Attorney, Agent, or Firm*—William J. Ruano

[57] ABSTRACT

A refractory insulating shield for water-cooled pipes in reheating furnaces and the like. The refractory insulating shield has an inner surface in which metallic mesh is partially embedded for reinforcing the shield. A portion of the mesh is exposed and devoid of insulating covering to provide a free pivot for two parts of the insulating shield. The shield may be of substantially trapezoidal cross-section and said free pivot enables mounting on any portion of the cross-rail without the necessity of sliding it onto the end thereof. A modification is to provide a two-part covering for only the lower half of the skid by having a readily detachable connection between the two parts.

4 Claims, 5 Drawing Figures

REFRACTORY INSULATING SHIELDS FOR WATER-COOLED PIPES

This invention relates to improvements in refractory insulating shields for either crossover or longitudinal skid water-cooled pipes as used in reheating furances and the like.

An outstanding disadvantage of conventionally used insulators for cross rails or pipes, or skid pipes of substantially trapezoidal cross-section is that no suitable readily detachable fastening means have been provided for mounting small lengths of insulation along selective portions of the pipe, thereby resulting in delays in assembly and additional cost.

An object of the present invention is to overcome the above-named disadvantages by providing a novel insulator for water-cooled skid pipe networks which will overcome the above-named disadvantage.

A more specific object of the invention is to provide a two-part insulator which is readily detachable and which can easily and quickly be mounted on skid pipes or cross-over pipes or rails.

Other objects and advantages of the invention will become more apparent from a study of the following description taken with the accompanying drawing wherein.

Figure 1:
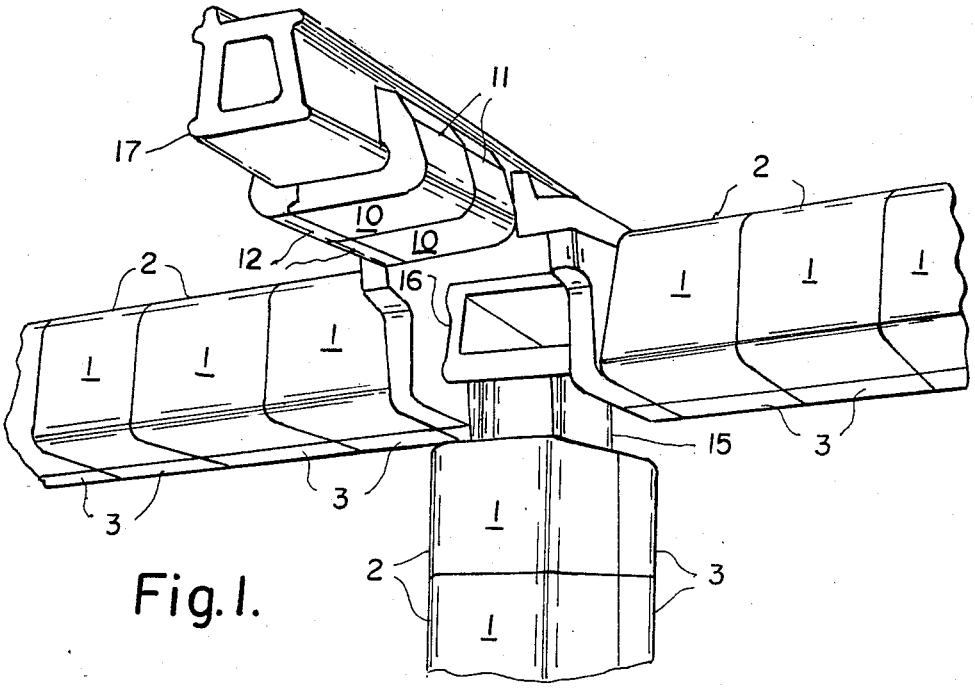
FIG. 1 is a water-cooled skid pipe network for a reheating furnace or the like wherein the cross rails and skid pipe have mounted thereon, an insulator embodying the present invention.

Referring more particularly to FIG. 1, which shows a water-cooled skid pipe network for reheating furnaces and the like, numeral 1 generally denotes insulators for covering the riser, cross-over rail or pipe, and skid pipe 17 of the system. The cross-over pipe is supported on the riser or vertical support and the skid pipe 17 is disposed at right angles on top of the cross-over pipe in the usual manner.

Figure 2:
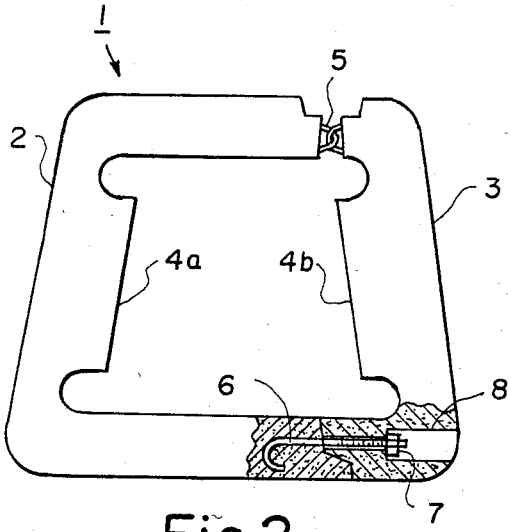
FIG. 2 is an enlarged end view, partly in cross-section, of an insulator for mounting on a cross-over rail or pipe shown in FIG. 1.
Figure 3:
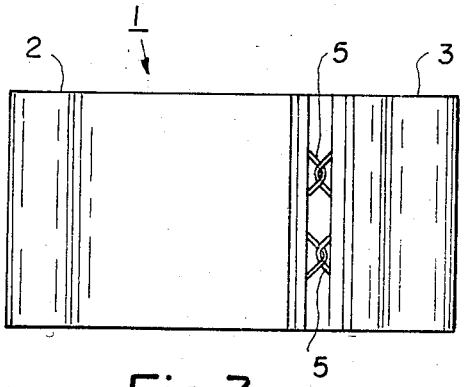
FIG. 3 is a top view of the insulator shown in FIG. 2.

FIGS. 2 and 3 show the construction of the refractory insulating material for the cross-over pipe and comprises two readily detachable insulating parts 2 and 3 providing a somewhat trapezoidal shape for closely fitting about a correspondingly shaped cross-over pipe which has horizontal projections of arcuate shape on the top and bottom of the pipe or rail. The inner surfaces 4*a* and 4*b* of the refractory insulator are inwardly and downwardly tapered. A reticulated wire mesh 5 is provided which extends throughout the periphery of the pipe,—that is, parts 2 and 3, and the end thereof is fastened to the hook of a J bolt 6 embedded in the refractory terminating in a threaded shank onto which a bolt 7 may be screwed after introduction into a slot 8.

In operation, it will be seen that parts 2 and 3 may be moved outwardly about the pivot provided by the exposed wire mesh portion 5, when the nut 7 is removed, and clamped onto any selected portion of the cross-over pipe or rail shown in FIG. 1. After the parts 2 and 3 are moved to the position shown in FIG. 2, the bolt 7 is tightened so as to provide a very tight grip about the cross-over pipe. In some instances, the reticulated wire 5 may have portions extending beyond the top and bottom inner surfaces of the insulator to provide a metallic contact with the cross-over pipe (not shown). In this manner, a plurality of insulators may be mounted on the cross-over pipe, as shown in FIG. 1. After the insulator is mounted, refractory grout is applied to fill the gap.

Figure 4:
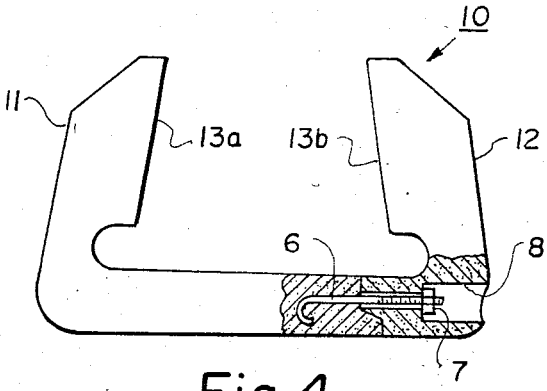
FIG. 4 is a side view, partly in cross-section of an insulator mounted on a skid rail 17 of FIG. 1.
Figure 5:
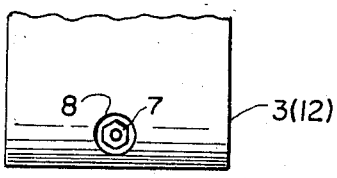
FIG. 5 is a side view as viewed from the right of FIG. 4.

FIGS. 4 and 5 show a modified insulator construction suitable for mounting on the skid rail 17 shown in FIG. 1 and comprising separable parts 11 and 12 which have inner surfaces 13*a* and 13*b* extending downwardly and outwardly. Thus when bolt 7 is unscrewed, the parts may be separately slid onto the skid rail or pipe 17 at any selected longitudinal position thereof and thereafter the bolt 7 is tightened to provide a close and secure fit.

Thus it will be seen that I have provided a readily detachable insulator to enable quick attachment to a cross-over pipe or skid rail of a water-cooled skid pipe or network for reheating furnaces or the like to provide improved heat transfer attributable to elimination of the need of the normal number of cross-over pipes and having lower cooling water requirement and minimizing heat loss to the piping system; also, I have provided a readily detachable means which will enable very speedy assembly or disassembly of insulators relative to the water cooled pipes.

While I have illustrated and described several embodiments of my invention, it will be understood that these are by way of illustration only and that various changes modifications may be contemplated in my invention and within the scope of the following claims.

I claim:

1. A refractory insulator in combination with a water-cooled pipe of substantially trapezoidal cross-section with projecting arcuate shoulders extending laterally outwardly from horizontal upper and lower ends thereof, said insulator closely surrounding at least the lower portion of said pipe and including two separate abutting parts connected together in a lower horizontal portion of said insulator adjacent one end of said lower horizontal portion of said insulator and a readily detachable means extending through said lower horizontal end of said insulator.

2. A refractory insulator as recited in claim 1, including a top portion surrounding the top portion of said pipe and including a gap, at one end of said top portion directly above said readily detachable means, a reticulated reinforcement wire extending across the gap and formed to provide a pivot for said two separate parts of said insulator, whereby the parts may be spread apart and selectively mounted on any longitudinal portion of a cross-over pipe of said network.

3. An insulator as recited in claim 1 wherein said detachable fastening means comprises a J bolt embedded in one of said parts, a threaded shank extending outwardly through a slot formed through the other of said parts, at said one end of said lower horizontal portion of said insulator, and a bolt screw threaded to said shank to detachably fasten said parts together.

4. An insulator as recited in claim 1 wherein said insulator surrounding the lower portion of said pipe has shoulder surrounding portions with top horizontal portions which are supported on said projecting arcuate shoulders extending from the lower ends of said pipe.

* * * * *